US008743007B2

(12) United States Patent
Kaneko et al.

(10) Patent No.: US 8,743,007 B2
(45) Date of Patent: Jun. 3, 2014

(54) SUBSTRATE TYPE ANTENNA

(75) Inventors: Tutomu Kaneko, Tokyo (JP); Takahisa Karakama, Nakano (JP)

(73) Assignees: NISSEI Limited, Tokyo (JP); Faverights, Inc., Nakano-shi (JP)

( * ) Notice: Subject to any disclaimer, the term of this patent is extended or adjusted under 35 U.S.C. 154(b) by 553 days.

(21) Appl. No.: 13/023,802

(22) Filed: Feb. 9, 2011

(65) Prior Publication Data

US 2011/0309989 A1 Dec. 22, 2011

(30) Foreign Application Priority Data

Jun. 16, 2010 (JP) ..... 2010-137468

(51) Int. Cl.
*H01Q 21/00* (2006.01)

(52) U.S. Cl.
USPC ..... 343/810; 343/812; 343/814

(58) Field of Classification Search
USPC ..... 343/810
See application file for complete search history.

(56) References Cited

U.S. PATENT DOCUMENTS 4,992,769 A * 2/1991 Oppelt ..... 336/180
5,917,386 A * 6/1999 Dobrovolny ..... 333/119
7,369,094 B2 * 5/2008 Song et al. ..... 343/816
7,728,427 B2 * 6/2010 Gabara ..... 257/723
2008/0204328 A1 * 8/2008 Nissinen ..... 343/700 MS

FOREIGN PATENT DOCUMENTS

JP 2007-142666 A 6/2007

* cited by examiner

*Primary Examiner* — Jerome Jackson, Jr.
*Assistant Examiner* — Andrea Lindgren Baltzell
(74) *Attorney, Agent, or Firm* — Crowell & Moring LLP

(57) ABSTRACT

The present invention provides a substrate type antenna capable of realizing high gain enhancement and high band enhancement in a simple configuration. In the substrate type antenna, a loop-like first joint pattern whose one spot is divided, is formed in one substrate surface of a substrate made of a dielectric material. Antennas are respectively connected to both end terminals of the first joint pattern at a position where the first joint pattern is divided. A loop-like second joint pattern formed at a position corresponding to the first joint pattern and whose one spot is divided, is formed in the other substrate surface of the substrate. A loop-like third joint pattern which is substantially concentric with the first joint pattern and which is formed at a position corresponding to the second joint pattern and whose spot is divided, is formed in the one substrate surface of the substrate. Other antennas are respectively connected to both end terminals of the third joint pattern at a position where the third joint pattern is divided.

3 Claims, 5 Drawing Sheets

SUBSTRATE TYPE ANTENNA

BACKGROUND OF THE INVENTION

1. Field of the Invention

The present invention relates to a substrate type antenna configured on a thin substrate.

2. Description of the Related Art

As a conventional substrate type antenna of this type, there has been known a configuration which has a substrate made of a dielectric material, a loop-like first coupled-portion or joint pattern formed at a first substrate surface of the substrate and divided at one spot thereof, and a loop-like second joint pattern formed at a second substrate surface of the substrate and divided at one spot, and in which electrostatic capacitively-coupled and magnetic inductively-coupled states are formed between the first joint pattern and the second joint pattern (refer to, for example, a patent document 1 (Japanese Patent Application Laid-Open No. 2007-142666)). According to such a configuration, unlike a conventional case in which patterns are formed on the same plane, the electrostatic capacitively-coupled and magnetic inductively-coupled states between the patterns by the substrate are greatly improved, and a high-frequency coupler excellent in transmission characteristic in a wide frequency band as compared with the conventional one can easily be obtained.

In the conventional substrate type antenna, however, its configuration increases in complexity if one attempts to achieve a further gain improvement by a combination of a plurality of antennas.

SUMMARY OF THE INVENTION

An object of the present invention is to provide a substrate type antenna configured to be capable of realizing high gain enhancement and high band enhancement in a simple configuration.

In order to attain the above object, the present invention provides a substrate type antenna comprising a loop-like first joint pattern, one spot of which being divided, which is formed in one substrate surface of a substrate made of a dielectric material; antennas respectively connected to both end terminals of the first joint pattern at a position where the first joint pattern is divided; a loop-like second joint pattern, one spot of which being divided, which is formed at a position corresponding to the first joint pattern, of the other substrate surface of the substrate; a loop-like third joint pattern, one spot of which being divided, which is formed concentrically with the first joint pattern at a position corresponding to the second joint pattern, of the one substrate surface; and other antennas respectively connected to both end terminals of the third joint pattern at a position where the third joint pattern is divided.

With this configuration, a plurality of antennas can simply be configured on a thin substrate while sharing feeding points of a second joint pattern formed in the other substrate surface, thereby making it possible to realize broadbanding at high gain, which cannot be obtained in the case of a single antenna.

In addition to the above configuration, the present invention includes another substrate disposed on the second joint pattern side of the substrate integrally therewith; a loop-like fourth joint pattern, one spot of which being divided, which is formed at a position corresponding to the second joint pattern, of a substrate surface on the side opposite to the second joint pattern at another substrate referred to above; and other antennas connected to both end terminals of the fourth joint pattern at a position where the fourth joint pattern is divided. This thus results in new addition of one antenna. Therefore, gain can be combined using three antennas in total, and high gain enhancement and broadbanding can further be achieved. Moreover, the tree antennas can be configured while sharing feeding points formed in the other substrate surface of the substrate, thus making it possible to simplify the entire configuration.

Further, in addition to the above configuration, the present invention includes another substrate disposed on the second joint pattern side of the substrate integrally therewith; a loop-like fourth joint pattern, one spot of which being divided, which is formed at a position corresponding to the second joint pattern, of a substrate surface on the side opposite to a surface on the side of formation of the second joint pattern at another substrate referred to above; a loop-like fifth joint pattern, one spot of which being divided, which is formed substantially concentrically with the fourth joint pattern and at the position corresponding to the second joint pattern; and other antennas respectively different from one another, which are respectively connected to both end terminals of the fourth and fifth joint patterns at the positions where the fourth joint pattern and the fifth joint pattern are divided. This thus results in new addition of two antennas. High gain enhancement and broadbanding can therefore be achieved. Further, the four antennas can be configured while sharing feeding points formed in the other substrate surface of the substrate, thus making it possible to simplify the entire configuration.

According to the substrate type antenna of the present invention, a plurality of antennas can simply be configured on a thin substrate while sharing feeding points of a second joint pattern formed in the other substrate surface, thus making it possible to realize broadbanding at high gain, which cannot be obtained in the case of a single antenna.

Other features and advantages of the present invention will become apparent upon a reading of the attached specification.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Preferred embodiments of the present invention will be explained hereinafter based on the accompanying drawings.

Figure 1:
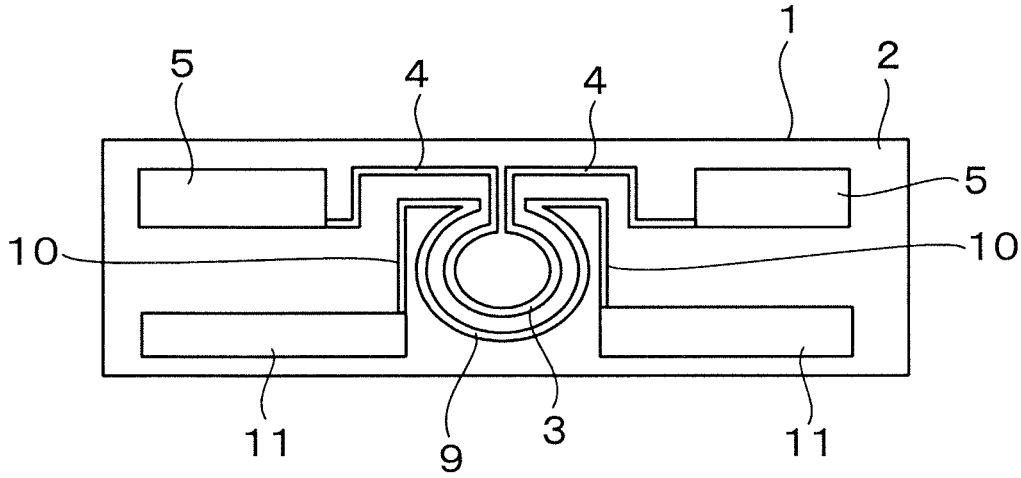
FIG. 1 is a plan view showing one substrate surface of a substrate type antenna according to one embodiment of the present invention.
Figure 2:
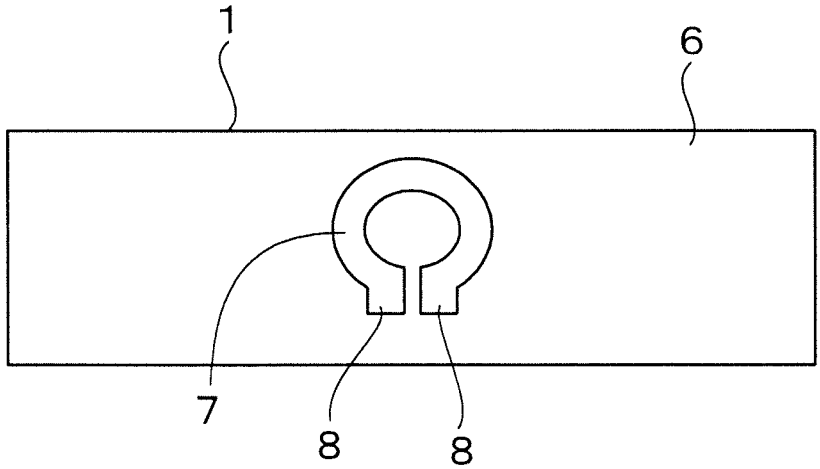
FIG. 2 is a plan view illustrating the other substrate surface of the substrate type antenna shown in FIG. 1.

FIGS. 1 and 2 are respectively plan views showing upper and lower surfaces of a substrate type antenna according to one embodiment of the present invention.

A loop-like first coupling-part or joint pattern 3, one spot of which is divided as shown in FIG. 1, is formed in an upper surface 2 corresponding to one substrate surface of a substrate 1 comprised of a dielectric material. Dipole antennas 5 are respectively connected to both end terminals of the first joint pattern 3 at a position where the first joint pattern 3 is divided, through electric paths 4. A loop-like second joint pattern 7, one spot of which being divided, is formed in a lower surface 6 corresponding to the other substrate surface of the substrate 1 shown in FIG. 2. Feeding points 8 are formed at their corresponding divided ends of the second joint pattern 7.

A loop-like third joint pattern 9 whose one spot is divided substantially concentrically with the first joint pattern 3 and with its divided position being substantially matched with the first joint pattern 3, and second dipole antennas 11 respectively connected to both end terminals of the third joint pattern 9 at the divided position thereof, through electric paths 10, are formed in the upper surface 2 of the substrate 1 shown in FIG. 1. Accordingly, the dipole antennas 5 and 11 are configured in parallel.

Now, the second joint pattern 7 formed on the lower surface 6 side is formed wider than the first joint pattern 3 and the third joint pattern 9 formed on the upper surface 2 side. An inner edge of the second joint pattern 7 is formed along the first joint pattern 3, and an outer edge thereof is formed along the third joint pattern 9.

The first joint pattern 3 and the second joint pattern 7 are disposed opposite to each other at the upper and lower surfaces of the substrate 1. Further, the third joint pattern 9 and the second joint pattern 7 are disposed opposite to each other, whereby an electrostatic capacitive coupling and a magnetic inductive coupling are formed at their opposite portions. The gains of both antennas 5 and 11 can be taken out or produced by these plural couplings.

The illustrated shapes of joint patterns 3, 7 and 9 are annular, but various shapes such as an ellipsoid, a polygon, their combinations, etc. can be adopted in addition to it. The shapes thereof may differ more or less on the upper and lower surface sides of the substrate 1. Further, the substrate 1 is configured as a flat substrate constant in thickness, but is not limited to it.

A description will next be made of high gain enhancement using the above-described substrate type antenna.

Here, the substrate 1 is configured as being 100 mm widthwise and 20 mm heightwise in FIG. 1. The first joint pattern 3 is configured as being 10 mm in inside diameter and 12 mm in outside diameter as viewed in the same widthwise direction. The third joint pattern 9 is configured as being 14 mm in inside diameter and 16 mm in outside diameter as viewed in the same widthwise direction. The second joint pattern 7 is configured as being 10 mm in inside diameter and 16 mm in outside diameter as viewed in the same widthwise direction in FIG. 2. Each of the antennas 5 is configured as being 34 mm widthwise and 5 mm heightwise in the same figure. Each of the antennas 11 is configured as being 40 mm widthwise and 5 mm heightwise in the same figure.

Figure 3:
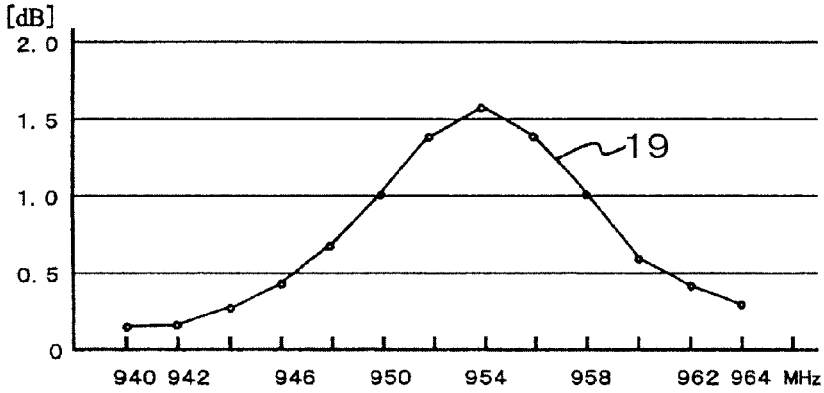
FIG. 3 is a gain characteristic diagram of one antenna shown in FIG. 1.
Figure 4:
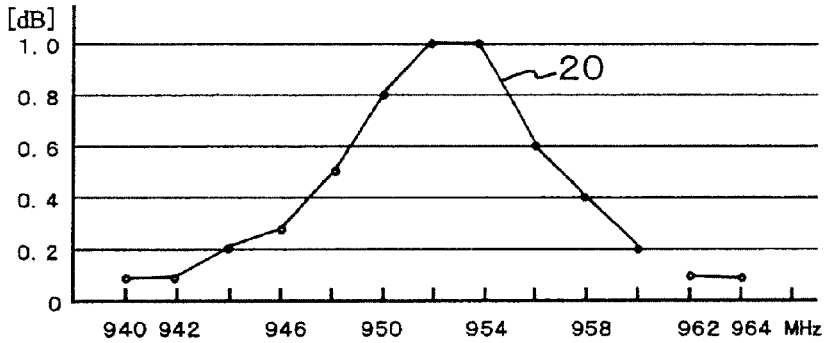
FIG. 4 is a gain characteristic diagram of the other antenna shown in FIG. 1.

A frequency gain characteristic curve 19 of the single antenna 5 under such a configuration is shown in FIG. 3. The gain obtained when the resonant frequency of the antenna 5 is adjusted to 954 MHz, is about 1.7 dB. On the other hand, a frequency gain characteristic curve 20 of the single antenna 11 is shown in FIG. 4. The gain obtained when the resonance frequency of the antenna 11 is adjusted to 954 MHz, is about 1.0 dB.

Figure 5:
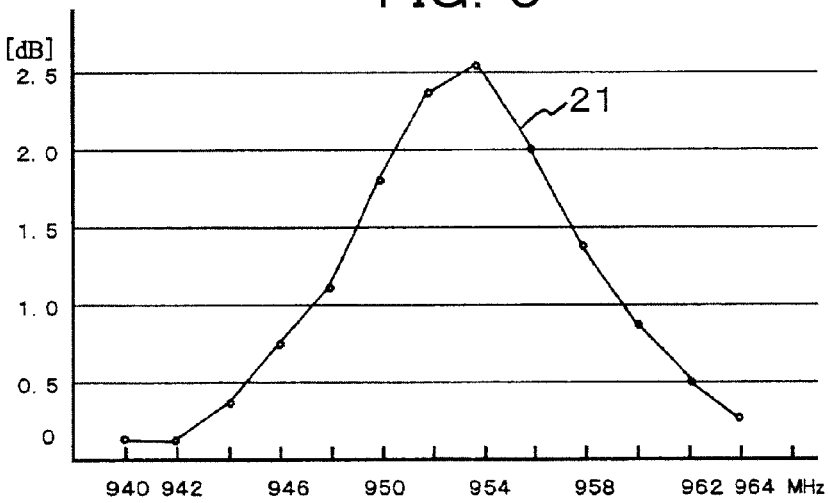
FIG. 5 is a combined gain characteristic diagram of the antennas shown in FIGS. 3 and 4.

When, however, the sizes and the like of the joint patterns 3, 7 and 9 are designed in such a manner that the gains of both antennas 5 and 11 are received at a characteristic impedance of 50Ω from the feeding points 8 of the second joint pattern 7, the resonant frequency is 954 MHz and a high gain of about 2.5 dB is obtained as in a frequency combined gain characteristic curve 21 shown in FIG. 5. Such a result cannot be obtained where the joint patterns 3 and 9 of the antennas 5 and 11 are brought into integral form.

A description will next be made of broadbanding of the above-described substrate type antenna.

Figure 6:
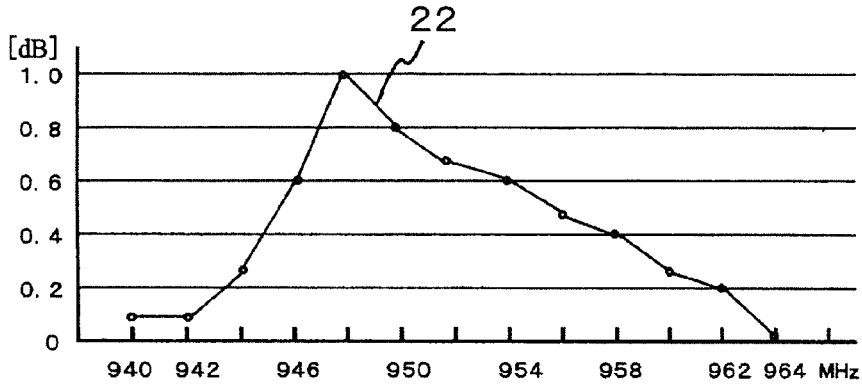
FIG. 6 is another gain characteristic diagram of the one antenna shown in FIG. 1.
Figure 7:
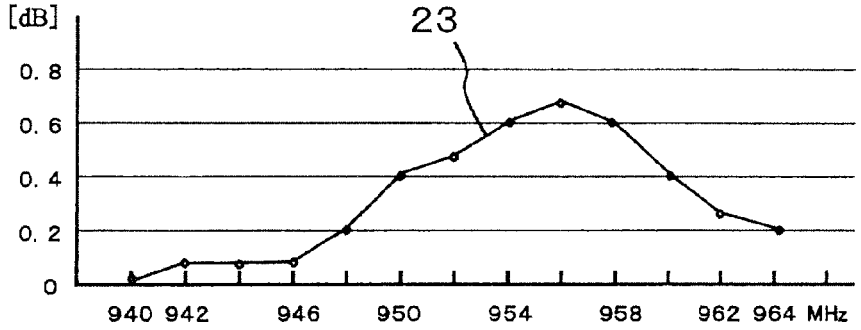
FIG. 7 is another gain characteristic diagram of the other antenna shown in FIG. 1.

FIG. 6 shows a frequency gain characteristic curve 22 of the single antenna 5. The gain obtained when the resonant frequency of the antenna 5 is adjusted to 948 MHz, is about 1.0 dB. On the other hand, FIG. 7 shows a frequency gain characteristic curve 23 of the single antenna 11. The gain obtained when the resonant frequency of the antenna 11 is adjusted to 956 MHz, is about 0.7 dB.

Figure 8:
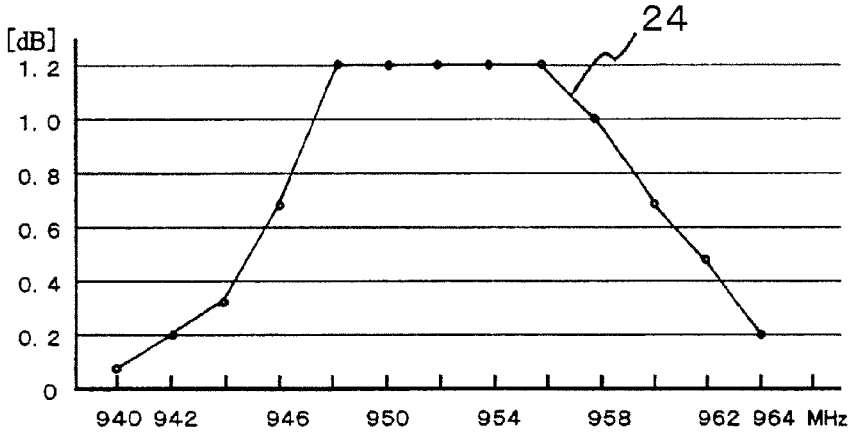
FIG. 8 is a combined gain characteristic diagram of the antennas shown in FIGS. 6 and 7.

When, however, the sizes and the like of the joint patterns 3, 7 and 9 are designed in such a manner that the gains of both antennas 5 and 11 are received at the characteristic impedance of 50Ω from the feeding points 8 of the second joint pattern 7, a high gain of about 1.2 dB is obtained in a wide band at which the resonant frequency ranges from 948 MHz to 956 MHz, as in a frequency combined gain characteristic curve 24 shown in FIG. 8.

Thus, the dual first and third joint patterns 3 and 9 are formed substantially concentrically in the one substrate surface of the substrate 1, and the antennas 5 and 11 different from one another are respectively connected to the divided portions of the joint patterns 3 and 9. Therefore, the antennas 5 and 11 and the joint patterns 3 and 9 can simply be configured on the thin substrate 1 while sharing the feeding points 8 of the second joint pattern 7 formed in the other substrate surface, thereby making it possible to realize broadbanding at high gain that cannot be obtained in the case of the single antenna.

Figure 9:
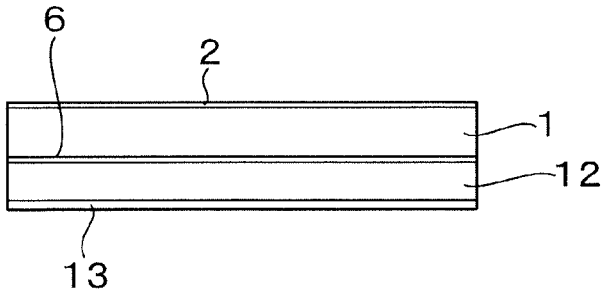
FIG. 9 is a side view of a substrate type antenna according to another embodiment of the present invention.

FIG. 9 is a side view showing a substrate type antenna according to another embodiment of the present invention.

Figure 10:
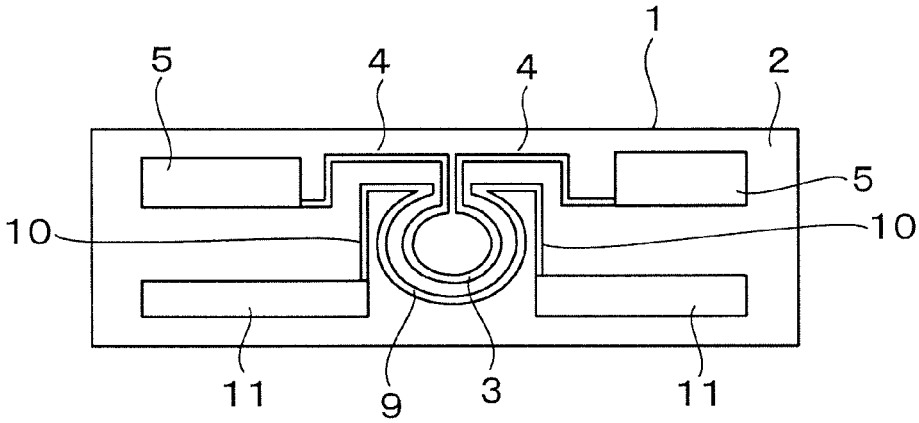
FIG. 10 is a plan view showing an upper surface of one substrate of the substrate type antenna shown in FIG. 9.
Figure 11:
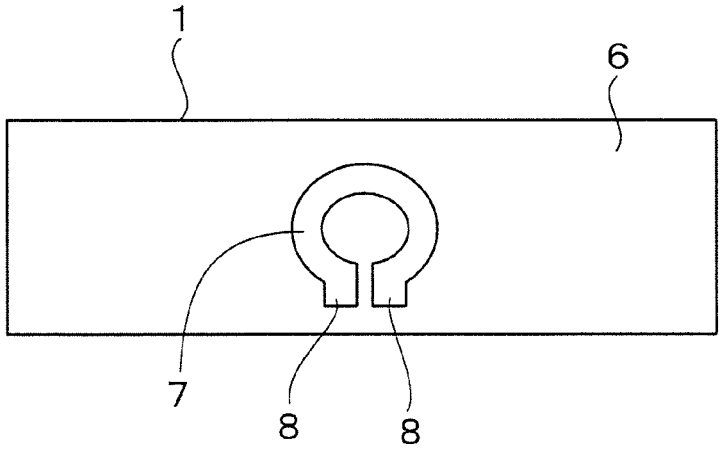
FIG. 11 is a bottom view of the substrate shown in FIG. 10.

In a manner similar to the previous embodiment, patterns whose details will be described later, are formed in upper and lower surfaces 2 and 6 of a substrate 1. Further, another substrate 12 is newly added to the lower surface 6 side, and new patters are formed in a lower surface 13 of the substrate 12. In exactly the same manner as the configuration shown in FIG. 1, a loop-like first joint pattern 3, a loop-like third joint pattern 9 substantially concentric in configuration with the first joint pattern 3, and antennas 5 and 11 are respectively formed in the upper surface 2 of the substrate 1 as shown in FIG. 10. In exactly the same manner as the configuration shown in FIG. 2, a loop-like second joint pattern 7 and feeding points 8 are formed in the lower surface 6 of the substrate 1 as shown in FIG. 11.

Figure 12:
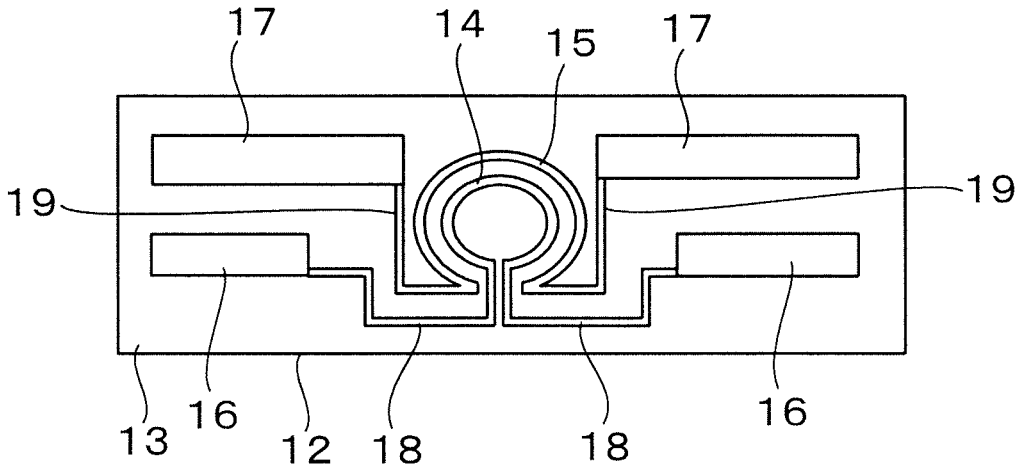
FIG. 12 is a bottom view of the other substrate of the substrate type antenna shown in FIG. 9.

On the other hand, a loop-like fourth joint pattern 14 whose one spot is divided, and a loop-like fifth joint pattern 15 substantially concentric in configuration with the fourth joint pattern 14 and whose approximately the same spot is divided, are respectively formed in the lower surface 13 of the substrate 12 as shown in FIG. 12. Parallel type two antennas 16 and 17 are configured on both sides of the fourth joint pattern 14 and the fifth joint pattern 15 respectively. Namely, the antennas 16 are connected to both end terminals of the fourth joint pattern 14 via electric paths 18 respectively. Likewise, the antennas 17 are connected to both end terminals of the fifth joint pattern 15 via electric paths 19 respectively.

Such substrates 1 and 12 are stacked on each other as shown in FIG. 9 and integrated therebetween by means of an adhesive or other means.

At this time, in addition to both antennas 5 and 11 being configured in a manner similar to the previous embodiment, the fourth joint pattern 14 and the fifth joint pattern 15 are disposed opposite to each other at the lower surface 13 of the substrate 12 and are electrostatically capacitively coupled to each other and magnetically inductively coupled to each other at their opposite portions. The fourth joint pattern 14 and the second joint pattern 7 are disposed opposite to each other on the upper and lower surface sides of the circuit substrate 12, and the fifth joint pattern 15 and the second joint pattern 7 are disposed opposite to each other on the upper and lower surface sides thereof, so that they are electrostatically capacitively and magnetically inductively coupled to one another at these respective opposite portions respectively, thus making it possible to extract or produced the gains of both antennas 16 and 17 by these plural couplings.

According to the substrate type antenna of such a configuration, since the antennas 16 and 17 are newly added, high gain enhancement and broadbanding can further be achieved as compared with the previous embodiment. Further, since, although the configuration according to the previous embodiment is made dual, the second joint pattern 7 having the feeding points 8 is configured at the lower surface 6 of the substrate 1, and the fourth joint pattern 14 and the fifth joint pattern 15 are formed in the lower surface 13 of another substrate 12 disposed below the substrate 1, the four antennas 5, 11, 16 and 17 can be configured with the feeding points 8 held in common, thereby making it possible to simplify the entire configuration.

As a further embodiment of the present invention, the lower surface 13 of the substrate 12 shown in FIG. 12 can also be used as another different configuration. For example, either the fourth joint pattern 14 and the fifth joint pattern 15 is configured at the lower surface 13 and either of the antenna 16 or 17 may be configured thereat in matching with it.

According to the substrate type antenna of such a configuration, one antenna is newly added thereto so that gain can be combined using three antennas in total, and high gain enhancement and broadbanding can further be achieved as compared with the embodiment shown in FIG. 1. Further, since the second joint pattern 7 having the feeding points 8 is configured at the lower surface 6 of the substrate 1, and the fourth joint pattern 14 or the fifth joint pattern 15 is formed in the lower surface 13 of another substrate 12 disposed below the substrate 1, the three antennas can be configured with the feeding points 8 held in common, thus making it possible to simplify the entire configuration.

Incidentally, although the number of the antenna patterns at the upper surface and the number of the antennas at the lower surface 13 are respectively limited to two on the right and left sides, the number of antennas is not limited if they can all be disposed opposite to the joint pattern V.

While the preferred forms of the present invention have been described, it is to be understood that modifications will be apparent to those skilled in the art without departing from the spirit of the invention. The scope of the invention is to be determined solely by the following claims.

What is claimed is:

1. A substrate type antenna comprising:

a loop-like first joint pattern one spot of which is divided, said first joint pattern being formed in one substrate surface of a substrate comprised of a dielectric material;

antennas respectively connected to both end terminals of the first joint pattern at a position where the first joint pattern is divided;

a loop-like second joint pattern one spot of which is divided, said second joint pattern being formed at the other substrate surface of the substrate;

a loop-like third joint pattern one spot of which is divided, said third joint pattern being formed concentrically with the first joint pattern at the one substrate surface of the substrate; and other antennas respectively connected to both end terminals of the third joint pattern at a position where the third joint pattern is divided, wherein the first and the third joint patterns are arranged at the one substrate surface so as to be within a range of a pattern formation of the second joint pattern at the other substrate surface in a vertical projection from the one substrate surface toward the other substrate surface, and in the vertical projection, the first joint pattern is arranged to overlap on a position along an inner edge of the second joint pattern and the third joint pattern is arranged to overlap on a position along an outer edge of the second joint pattern.

2. The substrate type antenna according to claim 1, further comprising:

another substrate disposed on the second joint pattern side of the substrate integrally therewith;

a loop-like fourth joint pattern one spot of which is divided, said loop-like fourth joint pattern being formed at a substrate surface on the opposite side to the second joint pattern at said another substrate;

other antennas respectively connected to both end terminals of the fourth joint pattern at a position where the fourth joint pattern is divided, wherein the fourth joint pattern is arranged within a range of a pattern formation of the second joint pattern in a vertical projection from the substrate surface on the opposite side to the another substrate toward the other substrate surface.

3. The substrate type antenna according to claim 1, further comprising:

another substrate disposed on the second joint pattern side of the substrate integrally therewith;

a loop-like fourth joint pattern one spot of which is divided, said fourth joint pattern being formed at a substrate surface on the opposite side to the second joint pattern at said another substrate;

other antennas respectively connected to both end terminals of the fourth joint pattern at a position where the fourth joint pattern is divided;

a loop-like fifth joint pattern one spot of which is divided, said fifth joint pattern being formed substantially concentrically with the fourth joint pattern and at a surface on the side of formation of the fourth joint pattern of said another substrate;

other different antennas respectively connected to both end terminals of the fifth joint pattern at a position where the fifth joint pattern is divided, wherein the fourth and the fifth joint patterns are arranged within a range of a pattern formation of the second joint pattern in a vertical projection from the substrate surface on the opposite side to the another substrate toward the other substrate surface.

* * * * *